US008955775B2

(12) United States Patent
Jansen

(10) Patent No.: US 8,955,775 B2
(45) Date of Patent: Feb. 17, 2015

(54) VALVE SYSTEM

(75) Inventor: Sebastian Jansen, Ludwigsberg (DE)

(73) Assignee: Robert Bosch GmbH, Stuttgart (DE)

( * ) Notice: Subject to any disclaimer, the term of this patent is extended or adjusted under 35 U.S.C. 154(b) by 279 days.

(21) Appl. No.: 13/321,236

(22) PCT Filed: May 25, 2010

(86) PCT No.: PCT/EP2010/057171

§ 371 (c)(1),
(2), (4) Date: Feb. 9, 2012

(87) PCT Pub. No.: WO2011/006707

PCT Pub. Date: Jan. 20, 2011

(65) Prior Publication Data

US 2012/0125451 A1 May 24, 2012

(30) Foreign Application Priority Data

Jul. 15, 2009 (DE) ..... 10 2009 027 727

(51) Int. Cl.

| | |
|---|---|
| ***F02M 51/06*** | (2006.01) |
| ***F02M 61/04*** | (2006.01) |
| ***F02M 45/08*** | (2006.01) |
| ***F02M 61/18*** | (2006.01) |
| ***F02M 63/00*** | (2006.01) |

(52) U.S. Cl.

CPC ..... *F02M 45/086* (2013.01); *F02M 61/042* (2013.01); *F02M 61/1893* (2013.01); *F02M 63/0029* (2013.01); *F02M 63/008* (2013.01); *F02M 2200/46* (2013.01)

USPC ..... 239/585.1

(58) Field of Classification Search

USPC ..... 251/30.01, 30.04, 30.02, 30.03, 77; 239/533.2, 585.1

See application file for complete search history.

(56) References Cited

U.S. PATENT DOCUMENTS 5,271,599 A * 12/1993 Kolchinsky et al. ..... 251/30.04
5,301,874 A * 4/1994 Vogt et al. ..... 239/585.4

(Continued)

FOREIGN PATENT DOCUMENTS

| | | |
|---|---|---|
| CN | 1651755 | 8/2005 |
| DE | 27 10 216 | 9/1978 |

(Continued)

OTHER PUBLICATIONS

International Search Report, PCT International Application No. PCT/EP2010/057171, dated Aug. 11, 2010.

*Primary Examiner* — John K Fristoe, Jr.
*Assistant Examiner* — Jonathan Waddy
(74) *Attorney, Agent, or Firm* — Kenyon & Kenyon LLP

(57) ABSTRACT

A valve system is described for high-pressure fuel injection, including a pilot valve which has a pilot valve needle, a pilot valve seat and a pressure chamber, an electromagnetic actuator for actuating the pilot valve needle, and a main valve which has at least one spray hole, a closing element, a support piston and a pressure compensating chamber, the closing element having a receiving chamber for the purpose of accommodating the support piston and the pressure compensating chamber being provided in the receiving chamber of the closing element, the pilot valve seat being provided on the closing element, and the pilot valve establishing a connection between the pressure chamber and the pressure compensating chamber for the purpose of reducing an opening force for the main valve.

12 Claims, 3 Drawing Sheets

(56) References Cited

U.S. PATENT DOCUMENTS

| | | | | |
|---|---|---|---|---|
| 5,899,389 | A * | 5/1999 | Pataki et al. | 239/533.2 |
| 6,296,197 | B1 * | 10/2001 | Boecking | 239/88 |
| 6,338,445 | B1 * | 1/2002 | Lambert et al. | 239/533.12 |
| 6,557,779 | B2 * | 5/2003 | Perr et al. | 239/96 |
| 6,820,827 | B1 * | 11/2004 | Boecking | 239/533.3 |
| 6,905,083 | B2 * | 6/2005 | Ricco | 239/533.2 |
| 7,051,960 | B2 * | 5/2006 | Oguma | 239/585.1 |
| 2002/0017576 | A1 * | 2/2002 | Boecking | 239/533.11 |
| 2008/0163852 | A1 * | 7/2008 | Kanne et al. | 123/472 |

FOREIGN PATENT DOCUMENTS

| | | |
|---|---|---|
| DE | 102004030447 | 1/2006 |
| JP | 2-80768 | 6/1990 |
| JP | 2004-504533 | 2/2004 |
| WO | WO 87/06308 | 10/1987 |

* cited by examiner

VALVE SYSTEM

FIELD OF THE INVENTION

The present invention relates to a valve system for high-pressure fuel injection, in particular for direct gasoline injection at pressures of more than 20 Mpa.

BACKGROUND INFORMATION

In valves for direct gasoline injection, a precise metering of the injected fuel quantity must be ensured even at high switching dynamics and high injection pressures. In conventional solenoid valve systems, the actuator used to drive the valve needle must apply high forces, which causes the switching dynamics to deteriorate. To enable injection even at pressures above 20 MPa, the smallest possible valve seat diameter is usually selected. However, this results in a reduced effective hydraulic surface and a very small remaining installation space for situating the injection holes of the injection nozzle. The resulting small flow cross section in the valve seat of the opened valve additionally results in unwanted reduction or throttling of the injection pressure.

This conventional approach is therefore only insufficiently suitable for use at further increased injection pressures, such as those required to reduce particle emissions in the exhaust gas.

SUMMARY

An example valve system according to the present invention may have the advantage that only low forces are required to open the valve even in high-pressure applications, and these forces may be provided with the aid of an economical electromagnetic actuator. Due to the example valve system according to the present invention, a sufficiently large flow cross section may be provided even for operation at injection pressures far above 20 MPa and at high switching dynamics, so that no inner throttling of the fuel to be injected occurs during the injection phase. This is achieved according to the example embodiment of the present invention by the fact that the hydraulic force to be overcome by the electromagnetic actuator during opening of the valve is drastically reduced by opening a pilot valve before a main valve is opened. This pilot valve has only a small seat diameter and is consequently subjected to only a low hydraulic closing force. Opening the pilot valve increases the pressure in a pressure compensating chamber, and the main valve may be opened almost force-free. The main valve may have a large seat diameter, so that no unwanted reduction of the injection pressure occurs in the area of the valve seat due to the throttling effect.

According to a further preferred embodiment of the present invention, the moving components of the valve, i.e., the pilot valve, the main valve and a magnet armature of the electric actuator, may be combined to form a separate assembly group which is easily assembled and adjusted independently of the remaining valve components and may be subsequently installed in the valve housing. This permits multiple assembly groups of this type to be manufactured in parallel.

A driver is preferably situated on a closing element of the pilot valve, this driver being able to be brought into contact with a pilot valve needle after the pilot valve opens, for the purpose of opening the main valve. As a result, the valve system according to the present invention may be manufactured faster and more economically due to the reduced number of components and the simple geometry of the components.

Moreover, a support piston of the main valve preferably has a spherical surface which is oriented toward a spray hole of a nozzle. This results in automatic tolerance compensation, since the support piston may be freely positioned within the closing element with regard to its angular position.

In particular, a closing diameter of a closing element of the main valve is preferably designed to be only slightly larger than the outer diameter of the support piston. Due to the thus very small resulting effective hydraulic surface of the fuel under high pressure at the closing element, only little opening force is required for the main valve. The closing diameter is preferably larger by 0.3 mm to 0.7 mm, in particular by a maximum of 0.5 mm.

According to a further preferred embodiment of the present invention, the electromagnetic actuator includes an inner pole which is situated in a housing of the valve system with the aid of a press fit. An adjusting sleeve, which is in contact with a first closing spring and which predefines a closing force of the closing spring via its position, is additionally situated in the inner pole with the aid of a press fit. The force of the closing spring or a tolerance compensation of the components to be assembled may be adjusted in this manner during assembly, since the position of the press fit is variable to a certain extent.

In the valve system according to the present invention, a gap seal is furthermore preferably provided between the support piston and the closing element. This achieves a low-leakage seal of the pressure compensating chamber with regard to the spray holes, while simultaneously achieving little friction and easy assembly of the components.

In addition, the support piston has a wide bevel on a side facing the spray hole. This permits a low-resistance flow of fuel to the spray holes.

In particular, the driver is preferably designed as a sleeve which is connected to the closing element. This reduces the number of loose components of the valve system and permits faster and simplified pre-assembly of the assembly group.

A second closing spring, which is supported on the pilot valve needle by a sleeve, furthermore preferably applies a force to the closing element. This reduces the contact force in the pilot valve seat, so that the pilot valve, and thus also the main valve, may be opened more rapidly. The first closing spring causes the valve to close more rapidly.

BRIEF DESCRIPTION OF THE DRAWINGS

An exemplary embodiment of the present invention is described in greater detail below with reference to the figures.

DETAILED DESCRIPTION OF EXAMPLE EMBODIMENTS

A valve system 1 of a fuel injection system according to a preferred exemplary embodiment of the present invention is described in detail below with reference to FIGS. 1 through 4.

Figure 1:
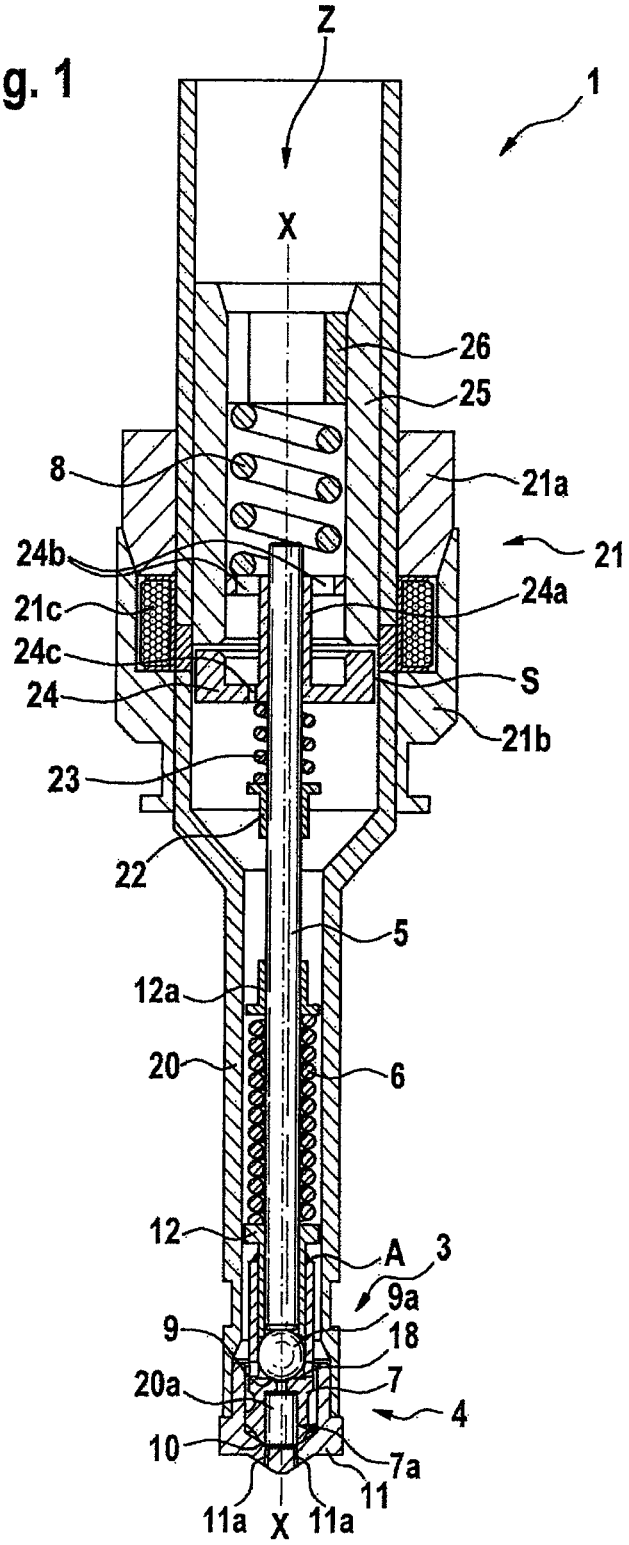
FIG. 1 shows a schematically simplified sectional representation of an example valve system according to the present invention in the closed state.

As is apparent from the schematic sectional representation in FIG. 1, valve system 1 includes a pilot valve 3, a main valve 4, an electromagnetic actuator 21 and a housing 20.

Pilot valve 3 includes a pilot valve needle 5, a pilot valve seat 9 and a pressure chamber 18. A pilot valve ball 9*a*, which is situated in pressure chamber 18, is attached to the injection-side end of pilot valve needle 5, e.g., with the aid of a weld. Pilot valve ball 9*a* is situated in a closing element 7 which is fixedly connected to a pilot valve lift adjusting sleeve 12 situated in the interior of closing element 7, with the aid of a weld A.

Valve system 1 furthermore includes a main valve 4, which has closing element 7, a main valve seat 10, a cylindrical support piston 20*a*, a pressure compensating chamber 13 (see FIG. 2) as well as spray holes 11*a*, which are situated in a nozzle 11. Closing element 7 has a receiving chamber 7*a* in which axially movable support piston 20*a* is situated in such a way that a gap seal 16 having a small gap height is formed between closing element 7 and support piston 20*a*.

A pressure compensating bore 19 is provided in closing element 7 between pilot valve seat 9 provided on closing element 7 and receiving chamber 7*a* of support piston 20*a* for the purpose of reducing an opening force for main valve 4. Pressure compensating chamber 13 is provided in receiving chamber 7*a* between support piston 20*a* and pressure compensating bore 19.

An inner pole 25 and a magnet armature 24 of electromagnetic actuator 21 are situated in the interior of housing 20 of valve system 1. A magnet cover 21*a* and a pot magnet 21*b* having a coil 21*c* of electromagnetic actuator 21 situated therein are provided on the outer circumference of housing 20. Situated in the interior of inner pole 25 is a first closing spring 8, which is in contact with an armature guide 24*a* of magnet armature 24, which is fixed in an end area of pilot valve needle 5. First closing spring 8 is pre-tensioned with the aid of a first closing spring adjusting sleeve 26, which is pressed into inner pole 25. A gap S is provided between the outer circumference of magnet armature 24 and the inner circumference of housing 20 in such a way that magnet armature 24 is movable within housing 20. A plurality of axial openings 24*b* and 24*c* is furthermore provided in magnet armature 24 and in armature guide 24*a* for the purpose of permitting unobstructed flow of fuel to the injection side. A pre-tensioned armature spring 23 is situated between magnet armature 24 and an armature spring adjusting sleeve 22 affixed to pilot valve needle 5 for the purpose of returning magnet armature 24 to the initial position when electromagnetic actuator 21 is deactivated.

A second closing spring 6 is situated between pilot valve lift adjusting sleeve 12 and a second closing spring adjusting sleeve 12*a*, which is affixed to pilot valve needle 5, e.g., with the aid of a weld.

Figure 2:
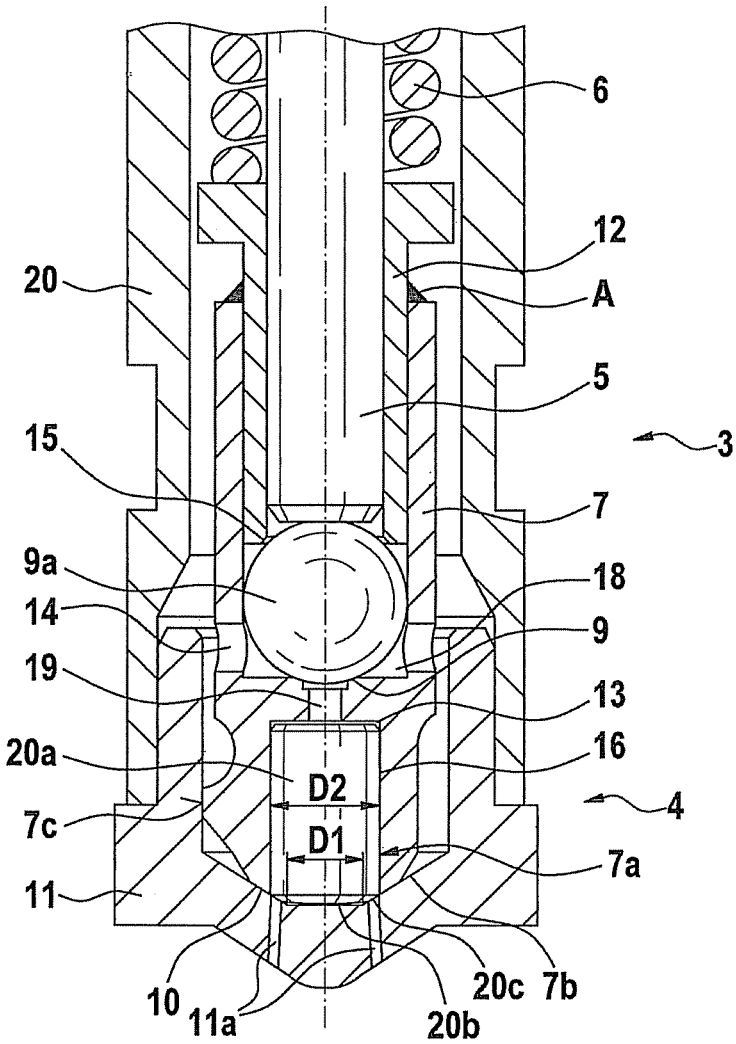
FIG. 2 shows a schematically simplified, enlarged sectional representation of the pilot valve and the main valve of an example valve system according to the present invention from FIG. 1.

Pilot valve 3 and main valve 4 of valve system 1 according to the present invention are illustrated in greater detail in the schematically simplified and enlarged sectional representation in FIG. 2. As is apparent from FIG. 2, support piston 20*a* has a central spherical surface 20*b* having a diameter D1 on the injection-side end, while an annular area is provided between diameter D1 of spherical surface 20*b* and an outer diameter D2 of support piston 20*a* in the form of a wide bevel 20*c*. Closing element 7 forms a seal against nozzle 11 at a closing diameter which is only slightly larger than outer diameter D2, closing element 7 resting against main valve seat 10 on the inner surface of nozzle 11. One or multiple area(s) on the injection-side end of closing element 7 is/are designed in the form of a flat area 7*b* to ensure unobstructed flow of fuel. In addition, one or multiple area(s) of closing element 7 is/are designed in the form of a guide surface 7*c* to provide a guide for closing element 7 on the inner surface of nozzle 11 (see FIG. 2). Alternatively, closing element 7 may also be guided via corresponding projections on nozzle 11.

As is furthermore apparent from FIG. 2, pilot valve ball 9*a* seals the pilot valve seat 9 provided on closing element 7, the fuel being supplied to pressure chamber 18 via radial connecting bores 14.

A driver 15, which is touched by pilot valve ball 9*a* attached to pilot valve needle 5 when lifting off pilot valve seat 9 after a predetermined lift, is provided on the injection-side end of pilot valve lift adjusting sleeve 12 for the purpose of moving pilot valve lift adjusting sleeve 12 and closing element 7 attached thereto in the direction of pilot valve spring 6 to open the main valve.

The function of valve system 1 according to the present invention is described below in a summary of FIG. 1 and FIG. 2.

When coil 21*c* of electromagnetic actuator 21 is energized, a magnetic force forms which moves magnet armature 24 in the direction of inner pole 25. The lift which may be executed by magnet armature 24 may be adjusted by appropriately adjusted pressing of inner pole 25 into housing 20. Pilot valve needle 5 moves in axial direction X-X together with pilot valve ball 9*a* attached thereto as soon as the magnetic force exceeds the difference between an elastic force F1 of first closing spring 8 and an elastic force F2 of second closing spring 6 plus a hydraulic closing force $F_{hyd}$ of pilot valve 3. Pilot valve 3 is opened at a magnetic force of 40 N−30 N+20 N=30 N, for example, at an elastic force F1 of 40 N and an elastic force F2 of 30 N, as well as a hydraulic force $F_{hyd}$ of 20 N (which corresponds to a hydraulic force at a pilot valve seat diameter of 0.8 mm and an injection pressure of 40 MPa). As soon as pilot valve ball 9*a* lifts off pilot valve seat 9, the fuel, which is under high pressure, flows into pressure compensating chamber 13 provided between support piston 20*a* and connecting bore 19, in which the high pressure builds up immediately thereafter. Closing element 7 may thus be lifted off main valve seat 10 nearly force-free. Pilot valve ball 9*a* is moved upward until it touches driver 15, which is provided on the end of pilot valve adjusting sleeve 12 facing pilot valve ball 9*a*. Closing element 7 is thereby lifted and exposes main valve seat 10 so that the fuel is able to flow through spray holes 11*a* in nozzle 11.

Closing element 7 moves in axial direction X-X until magnet armature 24 reaches the upper stop on inner pole 25. When coil 21*c* of electromagnetic actuator 21 is deactivated and the generated magnetic force disappears, pilot valve needle 5 is moved in the direction of the injection side, i.e., downward, by force F1 of first closing spring 8. As a result of the still active spring force F2 of second closing spring 6, pilot valve 3 remains open so that the fuel may flow back into the interior of housing 20 from pressure compensating bore 19 and lateral connecting bores 14 in closing element 7. Only after closing element 7 again rests against main valve seat 10 does pilot valve 3 begin to close again. This permits reliable closing of the pilot valve, due to the fact that elastic force F1 is selected to be greater than elastic force F2. When pilot valve ball 9*a* again rests against pilot valve seat 9, the injection valve is again completely sealed.

Figure 3:
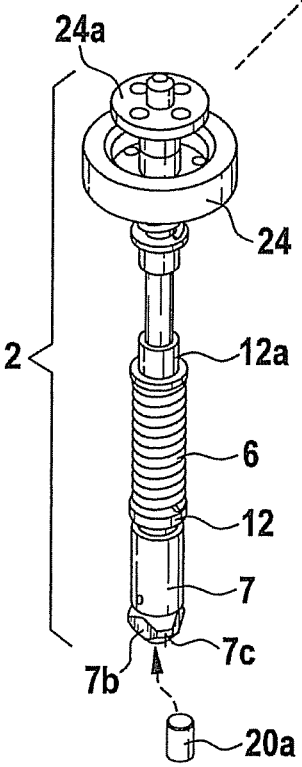
FIG. 3 shows a perspective representation of the pre-assembled assembly group of the example valve needle system.

FIG. 3 shows a perspective representation of a pre-assembled assembly group of a valve needle system 2 of valve system 1 according to the present invention.

Figure 4:
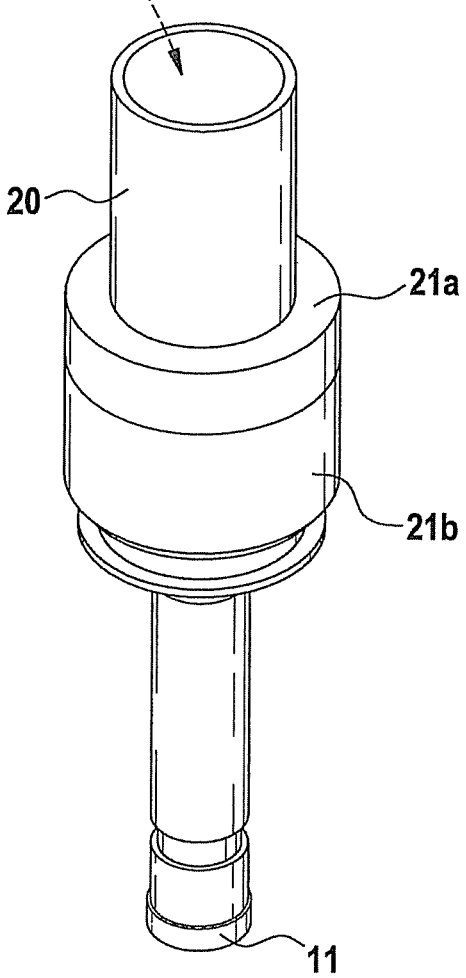
FIG. 4 shows a perspective representation of the housing which accommodates the pre-assembled assembly group.

Valve needle system 2 is assembled, by inserting pilot valve needle 5, along with pilot valve ball 9*a* welded thereto, into closing element 7, and by adjusting and fixing the pilot valve lift with the aid of pilot valve lift adjusting sleeve 12, e.g., by welding or alternatively by pressing or screwing to closing element 7. Second closing spring 6 may then be pushed onto pilot valve needle 5 and pre-tensioned to desired pre-tension force F2 by appropriately fixing second closing spring adjusting sleeve 12*a*. Magnet armature 24 is then pushed onto pilot valve needle 5. Magnet armature 24 may be either fixedly connected to pilot valve needle 5 or, as shown in FIG. 3, it may be optionally mounted on pilot valve needle 5 in an axially movable manner. In this case, armature spring 23 braces magnet armature 24 against armature guide 24*a*, which is fixedly connected to pilot valve needle 5. This enables magnet armature 24 to swing in the direction of the injection side after the injection valve closes, which reduces rebound. After support piston 20*a* has been inserted into closing element 7, valve needle system 2 is completely assembled and may be inserted in its entirety into housing 20, as shown in FIG. 4. Finally, inner pole 25, first closing spring 8, and first closing spring adjusting sleeve 26 are pressed into housing 20.

Illustrated valve needle system 2 provides valve system 1 according to the present invention with a controllable pressure compensation using a small number of additional components, i.e., closing element 7, pilot valve lift adjusting sleeve 12, support piston 20*a* as well as second closing spring 6 and second closing spring adjusting sleeve 12*a*. In this case, pilot valve needle 5, including pilot valve ball 9*a* attached thereto, may be used from existing valves according to the related art. Nozzle 11 may have either a conical or flat design in the area of main valve seat 10. In the case of a conical valve seat 10, it is advantageous to provide closing element 7 with a radius in the seat area which is large enough for main valve seat 10 to form the tangent to the resulting sphere segment. This makes it possible to achieve a reliable seal at main valve seat 10, even if closing element 7 is slightly tilted.

Valve system 1 according to the present invention has, in particular, a small number of components, which are geometrically easy to manufacture. The moving components of valve system 1 according to the present invention may be combined into a separate assembly group which are mounted independently of the other valve components and subsequently inserted into housing 20. In particular, simple adjustment of the valve lifts and also of the pre-tensioning forces of the springs is advantageous.

Due to the very low hydraulic forces and only small moving masses, valve system 1 according to the present invention may provide high switching dynamics even at high injection pressures.

The modular configuration of valve system 1 permits easy adaptation, in particular, for future applications at further increased injection pressures. Individual components, e.g., the nozzle, may be economically adapted and exchanged according to the specific requirements by modifying the seat diameter and/or the number of spray holes and/or the spray hole geometry.

In addition, valve system 1 permits an assembly process which is largely similar to that of manufacturing mass-produced injection valves according to the related art and is thus suitable for mass producing injection valves. The valve system according to the present invention is furthermore characterized by installation compatibility with currently available high-pressure injection valves.

What is claimed is:

1. A valve system for high-pressure fuel injection, comprising:

a pilot valve which has a pilot valve needle, a pilot valve seat and a pressure chamber; an electromagnetic actuator for actuating the pilot valve needle; and a main valve having at least one spray hole, a closing element, a support piston and a pressure compensating chamber, the closing element having a receiving chamber for accommodating the support piston, the pressure compensating chamber being provided in the receiving chamber of the closing element;

wherein the pilot valve seat is provided on the closing element, and the pilot valve establishes a connection between the pressure chamber and the pressure compensating chamber for reducing an opening force for the main valve, and wherein a driver, which is configured to be brought into contact with the pilot valve needle after the pilot valve opens, is situated on the closing element for opening the main valve.

2. The valve system for high-pressure fuel injection as recited in claim 1, wherein the pilot valve, the main valve, and a magnet armature of the electromagnetic actuator form an assembly group which is pre-assembled.

3. The valve system for high-pressure fuel injection as recited in claim 1, wherein the support piston has a spherical surface which is oriented toward the spray hole.

4. The valve system for high-pressure fuel injection as recited in claim 1, wherein a closing diameter of the closing element is only slightly larger than an outer diameter of the support piston.

5. The valve system for high pressure fuel injection as recited in claim 4, wherein the closing diameter is larger than the outer diameter of the support piston by 0.5 mm to 0.7 mm.

6. The valve system for high pressure fuel injection as recited in claim 4, wherein the closing diameter is larger than the outer diameter of the support piston by a maximum of 0.5 mm.

7. The valve system for high-pressure fuel injection as recited in claim 1, wherein the electromagnetic actuator includes an inner pole, the inner pole being situated in a housing of the valve system with the aid of a press fit.

8. The valve system for high-pressure fuel injection as recited in claim 7, further comprising:

an adjusting sleeve situated in the inner pole with the aid of a press fit, the adjusting sleeve being in contact with a closing spring, and a position of the adjusting sleeve within the inner pole predefining a closing force of the closing spring.

9. The valve system for high-pressure fuel injection as recited in claim 7, further comprising:

a gap seal between the support piston and the closing element.

10. The valve system for high-pressure fuel injection as recited in claim 1, wherein the support piston has a wide bevel on a side which is oriented toward the spray hole.

11. The valve system for high-pressure fuel injection as recited in claim 1, wherein the driver is a sleeve which is connected to the closing element.

12. A valve system for high-pressure fuel injection, comprising:

a pilot valve which has a pilot valve needle, a pilot valve seat and a pressure chamber; an electromagnetic actuator for actuating the pilot valve needle;

a main valve having at least one spray hole, a closing element, a support piston and a pressure compensating chamber, the closing element having a receiving chamber for accommodating the support piston, the pressure compensating chamber being provided in the receiving chamber of the closing element; and an adjusting sleeve situated in an inner pole with the aid of a press fit, the adjusting sleeve being in contact with a closing spring, and a position of the adjusting sleeve within the inner pole predefining a closing force of the closing spring;

wherein the pilot valve seat is provided on the closing element, and the pilot valve establishes a connection between the pressure chamber and the pressure compensating chamber for reducing an opening force for the main valve, wherein the electromagnetic actuator includes the inner pole, the inner pole being situated in a housing of the valve system with the aid of a press fit, and wherein a second closing spring, which is supported on the pilot valve needle via a sleeve, applies a force to the closing element for pressing the closing element into the main valve seat.

* * * * *